US007902531B2

(12) United States Patent
Ijzerman et al.

(10) Patent No.: US 7,902,531 B2
(45) Date of Patent: Mar. 8, 2011

(54) WINDOW ASSEMBLY FOR IRRADIATING INFRARED LIGHT

(75) Inventors: Willem Lubertus Ijzerman, Eindhoven (NL); Michel Cornelis Josephus Marie Vissenberg, Eindhoven (NL); Marcellinus Petrus Carolus Michael Krijn, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 32 days.

(21) Appl. No.: 12/444,739

(22) PCT Filed: Oct. 8, 2007

(86) PCT No.: PCT/IB2007/054077

§ 371 (c)(1), (2), (4) Date: Apr. 8, 2009

(87) PCT Pub. No.: WO2008/044185

PCT Pub. Date: Apr. 17, 2008

(65) Prior Publication Data

US 2010/0014297 A1 Jan. 21, 2010

(30) Foreign Application Priority Data

Oct. 12, 2006 (EP) ..... 06122158

(51) Int. Cl.
*H05B 3/00* (2006.01)

(52) U.S. Cl. ..... 250/504 R; 359/350; 359/359; 359/591; 359/594; 359/597; 362/615; 362/616; 362/617

(58) Field of Classification Search ..... 250/504 R; 359/350, 359, 591–594, 597; 362/615–617
See application file for complete search history.

(56) References Cited

U.S. PATENT DOCUMENTS

| | | | | |
|---|---|---|---|---|
| 2,112,147 | A | 3/1938 | Downer | |
| 7,147,903 | B2 * | 12/2006 | Ouderkirk et al. | 428/35.7 |
| 2005/0105303 | A1 * | 5/2005 | Emde | 362/616 |
| 2005/0201116 | A1 * | 9/2005 | Browne et al. | 362/509 |
| 2006/0078318 | A1 | 4/2006 | Misumi et al. | |

FOREIGN PATENT DOCUMENTS

DE 9104334 U1 6/1991

(Continued)

*Primary Examiner* — Bernard E Souw
*Assistant Examiner* — Michael Maskell
(74) *Attorney, Agent, or Firm* — Larry Liberchuk

(57) ABSTRACT

A window assembly (100,110,120,130) for irradiating infrared light (L) comprises a light guide (5) for infrared light (L), which is formed by a gap between a first transparent substrate (2), having an exterior surface and an interior surface, which faces the light guide (5), and a second transparent substrate (3) substantially parallel to the first transparent substrate (2) and having an exterior surface and an interior surface, which faces the light guide (5) and the interior surface of the first transparent substrate (3). A first and a second reflective layer (12,13), that are both substantially reflective for infrared light (L), extend over the interior surfaces of respectively the first and the second transparent substrate (2,3). The second reflective layer (13) is provided with an opening (21) through which at least part of the infrared light (L) exits the light guide (5). In one embodiment, the window assembly further comprises an infrared light source (1) for directing the infrared light (L) into the light guide (5). In this way the infrared light (L) leaves the light guide (5) in one main direction through the opening (21) of the second reflective layer (13) and through the second transparent substrate (3), thereby generating heat in one main direction only.

10 Claims, 2 Drawing Sheets

FOREIGN PATENT DOCUMENTS

| | | | | |
|---|---|---|---|---|
| DE | 102005010702 | A1 | | 9/2006 |
| GB | 2174745 | A | | 11/1986 |
| GB | 2267563 | A | * | 12/1993 |
| JP | 63297245 | A | | 12/1988 |
| WO | 0244612 | A2 | | 6/2002 |
| WO | 2004007887 | A1 | | 1/2004 |

* cited by examiner

WINDOW ASSEMBLY FOR IRRADIATING INFRARED LIGHT

FIELD OF THE INVENTION

The invention relates to a window assembly for irradiating infrared light.

BACKGROUND OF THE INVENTION

Methods to manage infrared radiation from the sun are widely used in buildings. For example, there are windows equipped with coatings that reflect the infrared radiation from sun in order to avoid a too high heating up of the inside of the building. Those coatings typically comprise thin metal films of copper, gold or silver, which are transparent for visible light and reflective for infrared light. A more advanced heat management is obtained by means of so called smart coatings. These coatings are based on thermochromic materials, which have reflective properties that change with temperature. In the winter these coatings are transparent for infrared light from the sun and in the summer these coatings reflect the infrared light. In this way the inside of the building is heated by the sun in the winter and not heated by the sun in the summer. Furthermore, there exist windows in buildings that are equipped with a conductive coating, such as for example indium tin oxide (ITO). By means of an electric current the window is heated thereby creating infrared radiation and thus heating the inside of the building.

JP-63297245 discloses far infrared radiation glass that generates and radiates intense far infrared radiation in a room to warm a room in high efficiency by forming a far infrared radiation layer on a plate glass. The disadvantage of this construction is that the same amount of heat is radiated to the outside of a building as to the inside of the building thus loosing approximately half of the infrared radiation.

SUMMARY OF THE INVENTION

It is an object of the invention to provide for a window assembly for irradiating infrared light into one main direction without a natural infrared source, such as the sun. The invention is defined by the independent claims. Advantageous embodiments are defined by the dependent claims.

This object is achieved by the window assembly according to the invention, which is characterized in that the window assembly for irradiating infrared light comprises a light guide for infrared light, which is formed by a gap between a first transparent substrate, having an exterior surface and an interior surface, which faces the light guide, and a second transparent substrate substantially parallel to the first transparent substrate and having an exterior surface and an interior surface, which faces the light guide and the interior surface of the first transparent substrate, wherein a first and a second reflective layer, that are both substantially reflective for infrared light, extend over the interior surfaces of respectively the first and the second transparent substrate and wherein the second reflective layer is provided with an opening through which at least part of the infrared light exits the light guide. In this way the infrared light leaves the light guide in one main direction through the opening of the second reflective layer and through the second transparent substrate, thereby generating heat in one main direction only.

An embodiment of the window assembly according to the invention further comprises an infrared light source for directing infrared light into the light guide. An advantage of this embodiment is that more heat is created because of the use of an infrared light source for generating the infrared light. Another advantage is that heat is generated without applying a natural infrared source, such as the sun.

An embodiment of the window assembly according to the invention further comprises means for directing the infrared light from the infrared light source into the light guide in a direction that is not parallel to the interior surfaces of the first and second transparent substrate. In this way the infrared light is directed to the reflective first and/or second reflective layer and will eventually exit the light guide via the opening in the second reflective layer. In a further embodiment of the window assembly according to the invention, the directing means comprises a parabolic reflector partially surrounding the infrared light source. The parabolic reflector or mirror collimates the infrared light to such an extent that the infrared light from the infrared light source is directed into the light guide. In an advantageous embodiment according to the invention, the parabolic reflector is movable around the infrared light source. This provides for a simple way of directing the infrared light such that it will be reflected on the first and/or second reflective layer.

In an embodiment of the window assembly according to the invention a further reflector for infrared light is located in the light guide in the proximity of the infrared light source. This provides for a redirection of the infrared light from the infrared light source into the direction of the first and/or second reflective layers.

An embodiment of the window assembly according to the invention, further comprises a reflector located on the second transparent substrate for redirecting the exiting infrared light. This provides for a way to redirect the infrared light that exits through the opening of the second reflective layer into a preferred direction. In a further embodiment according to the invention, the reflector for infrared light is located on the exterior surface of the second transparent substrate. In this way the reflector is easier to adapt, move or remove when not in use. In an advantageous embodiment according to the invention, the reflector is transparent for visible light.

In an embodiment of the window assembly according to the invention the infrared light source is located outside the light guide and faces the exterior surface of the first transparent substrate or the exterior surface of the second transparent substrate. This allows for a simple maintenance of the infrared light source.

BRIEF DESCRIPTION OF THE DRAWINGS

These and other aspects of the invention will be further elucidated and described with reference to the drawings, in which.

The figures are not drawn to scale. In general, identical components are denoted by the same reference numerals in the figures.

DETAILED DESCRIPTION OF EMBODIMENTS

Figure 1:
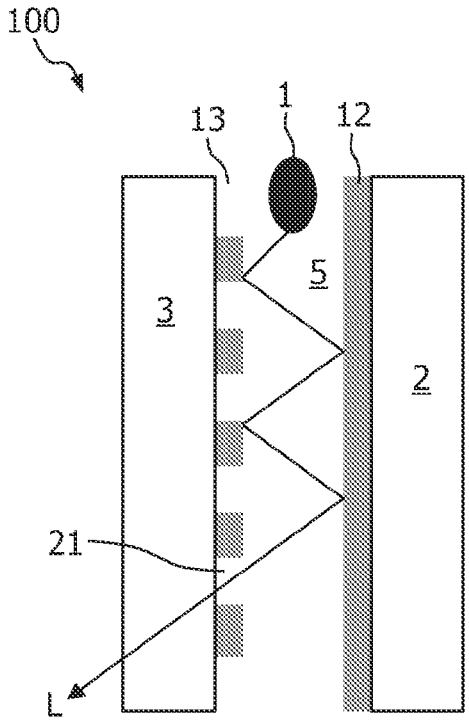
FIG. 1 is a schematic cross-sectional view of a first embodiment of a window assembly according to the invention.

FIG. 1 is a schematic cross-sectional view of a first embodiment of a window assembly according to the invention. In this first embodiment a window assembly 100 comprises a first window pane 2 that is placed parallel to a second window pane 3 wherein the first window pane 2 and the second window pane 3 are separated by a light guide 5, which is formed by a gap between the first window pane 2 and the second window pane 3. The first window pane 2 and the second window pane 3 are both transparent for visible light and infrared light, and are made of, for example, glass, preferably of insulating glass. The surface of the first window pane 2 that faces the light guide 5 is coated with a first reflective layer 12, and the surface of the second window pane 3 that faces the light guide 5 is coated with a second reflective layer 13. The first reflective layer 12 and the second reflective layer 13 are both reflective for infrared light. Preferably, the first reflective layer 12 and the second reflective layer 13 are both transparent for visible light. An infrared light source 1 is, in this embodiment, located inside the light guide 5 and radiates infrared light L into the remainder of the light guide 5. The infrared light L is reflected on the surface of the first reflective layer 12 and on the surface of the second reflective layer 13. To enable the infrared light L to exit the light guide 5, the second reflective layer 13 is provided with openings 21. As is shown in FIG. 1, the infrared light L exits the light guide 5 via at least one of the openings 21 in the second reflective layer 13. The opening 21 is transparent for infrared light and for visible light. The size and density of the openings 21 determines the amount of infrared light L that exits the light guide 5. Preferably the openings 21 are small enough that they are hardly visible and distributed in such a way that there is a uniform heating, and the openings 21 are large enough to let a substantial part of the infrared light L exit the second window pane 3 before the bottom or end of the light guide 5 is reached. The advantage of this construction is that the infrared light L leaves the light guide 5 only in directions that are mainly oriented downward, which is the main direction into which the infrared light L is radiated into the remainder of the light guide 5 by the infrared light source 1, and to one side, which in this case is the side of the second window pane 3. So, the window assembly 100 behaves as a directional source for the infrared light L.

The reflective layers 12 and 13 are, for example, coated with an indium-tin-oxide (ITO) layer, which is an electrically conductive material that is able to generate heat in case a current or a voltage is applied. Another example of a material, that may be applied for the first reflective layer 12 and the second reflecting layer 13, is copper, gold or silver. To protect these metal layers against corrosion and to increase the transmittance of visible light, the metal coating may be sandwiched between dielectric coating layers such as $TiO_2$, $Bi_2O_3$ and/or ZnO. Also combinations of these layers are possible. The light guide 5 is, for example, filled with air, because the absorption of the infrared light L in air is relatively low. It is also possible to apply another material, which has a sufficiently low absorption, like quartz. Preferably the light guide 5 is filled with an inert gas, to lower the absorption of the infrared light L in the light guide 5 further.

The infrared light source 1 is, for example, an infrared lamp or a LED (Light Emitting Diode) source. The window assembly according to the invention should mimic the heat radiated by the sun through a window, which is characterized by the intensity of that radiation. In a practical situation in the order of several hundreds of Watts per square meter of solar radiation is radiated through a window pane, taking into account, amongst others, the transmittance of the solar radiation by the window pane. Therefore, an infrared lamp is preferred, because typical infrared lamps are available from 500 Watt to 3000 Watt or more.

Figure 2:
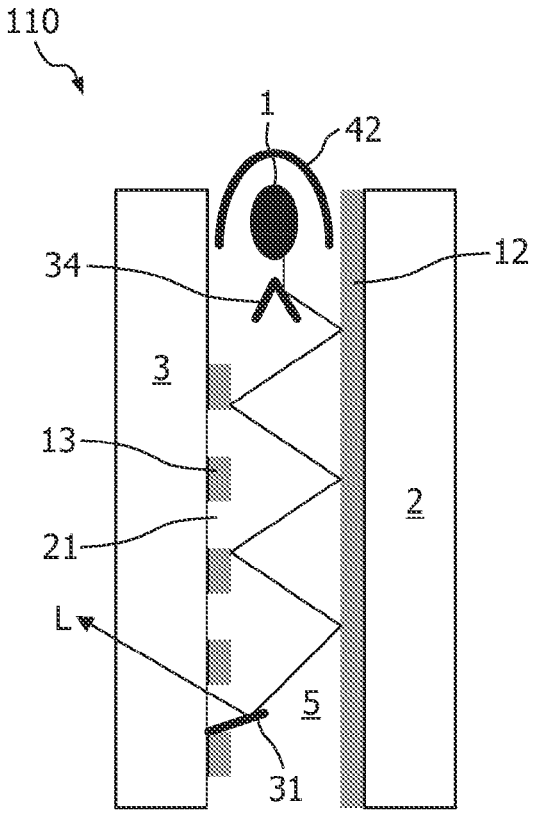
FIG. 2 is a schematic cross-sectional view of a second embodiment of a window assembly according to the invention.

FIG. 2 is a schematic cross-sectional view of a second embodiment of a window assembly according to the invention. Like parts are numbered in the same way as in the previous figures. In this second embodiment a window assembly 110 comprises a parabolic mirror 42 that is placed near the infrared light source 1 in order to collimate the infrared light L generated by the infrared light source 1 such that a substantial part of the infrared light L is directed directly into the remainder of the light guide 5. Preferably the infrared light L enters the light guide 5 with an angle not equal to zero with the surface of the first and second window pane 2,3 to provide for most of the infrared light L exiting the light guide 5 through the second window pane 3 and reaching the first reflective layer 12 or the second reflective layer 13. For this purpose the window assembly 110 comprises a first reflector 34, which is reflective for the infrared light L and redirects the infrared light L by reflection, that is radiated by the infrared light source 1 directly or via the parabolic mirror 42, into a direction that is not parallel to the surfaces of the first and second reflective layers 12, 13. Furthermore, the window assembly 110 comprises a second reflector 31, which is reflective for the infrared light L and redirects the exiting infrared light L. The second reflector 31 is, in this embodiment, located inside the light guide 5 at or near the opening 21, as is shown in FIG. 2. In this way, it is possible to direct the exiting infrared light L into a direction that is different from the downward direction, which is the main direction into which the infrared light L is radiated by the infrared light source 1 and the parabolic mirror 42. Additionally, more second reflectors 31 can be placed at or near the other openings 21. The second reflector 31 comprises, for example, aluminum, or a material that is both reflective for infrared light and transparent for visible light.

Figure 3:
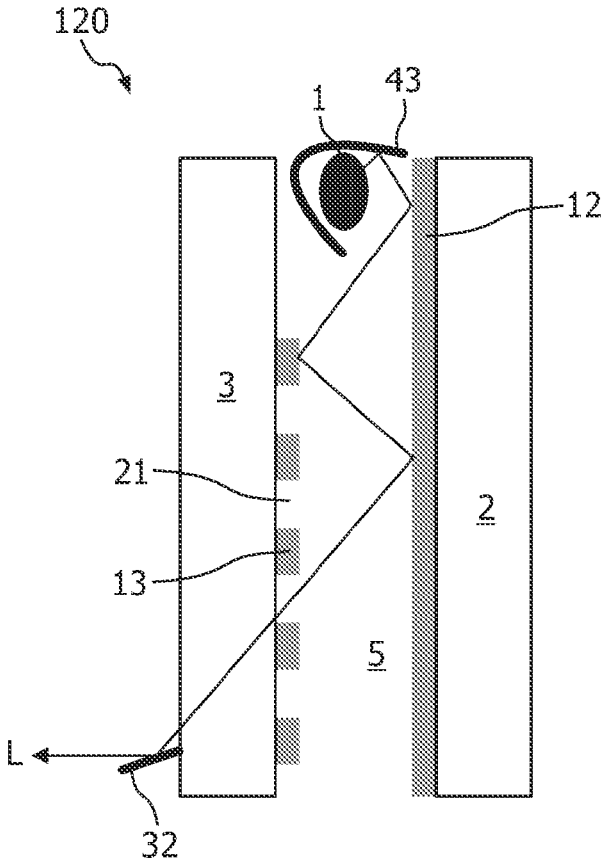
FIG. 3 is a schematic cross-sectional view of a third embodiment of a window assembly according to the invention.

FIG. 3 is a schematic cross-sectional view of a third embodiment of a window assembly according to the invention. Like parts are numbered in the same way as in the previous figures. In this third embodiment a window assembly 120 comprises a movable parabolic mirror 43 that is placed near the infrared light source 1 in order to collimate the infrared light L generated by the infrared light source 1 such that a substantial part of the infrared light L is directed directly into the remainder of the light guide 5. The movable parabolic mirror 43 can be moved or pivoted into another position near the infrared light source 1 such that the infrared light L, which is radiated by the infrared light source 1, is directed into a direction that is not parallel to the surfaces of the first and second reflective layers 12, 13. The window assembly 120 comprises a third reflector 32, which is placed on an exterior surface of the second window pane 3, which surface is opposing the coated surface of the second window pane 3. The third reflector 32 is reflective for the infrared light L and redirects the exiting infrared light L by reflection, as is shown in FIG. 3. Additionally, more third reflectors 32 can be placed on the exterior surface of the second window pane 3, preferably formed from well-known lamella. In this way, it is possible to direct the exiting infrared light L into a direction that is different from the downward direction, which is the main direction into which the infrared light L is radiated by the infrared light source 1 and the movable parabolic mirror 43. In case lamella are applied that can be pivoted into another position, the direction of the exiting light L can be varied. The third reflector 32 comprises, for example, aluminum, or a material that is both reflective for infrared light and transparent for visible light. A further advantage of the third reflector 32 is ease of maintenance, because it is difficult to reach the second reflector 31 of window assembly 110 being placed inside the light guide 5, whereas the third reflector 32 of window assembly 120 is placed outside the light guide 5 making the third reflector 32 easy to reach and maintain.

Figure 4:
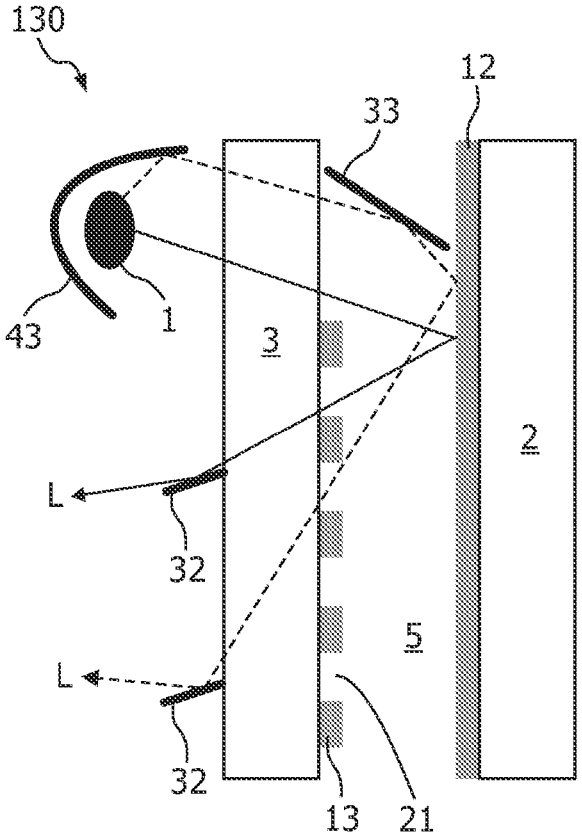
FIG. 4 is a schematic cross-sectional view of a fourth embodiment of a window assembly according to the invention.

FIG. 4 is a schematic cross-sectional view of a fourth embodiment of a window assembly according to the invention. Like parts are numbered in the same way as in the previous figures. The fourth embodiment comprises a window assembly 130 in which the infrared light source 1 is placed outside the light guide 5 at the side of the second window pane 3, facing the exterior surface of the second window pane 2, thus providing for an easy access of the infrared light source 1, for example for maintenance. Alternatively, the light source 1 can be placed outside the light guide 5 facing the exterior surface of the first window pane 2. The movable parabolic mirror 43 that is placed near the infrared light source 1, collimates the infrared light L generated by the infrared light source 1 such that a substantial part of the infrared light L is directed into the light guide 5 via the second window pane 3. The angular spread of the infrared light L is in this case such that it enters the light guide 5 in that area where the second reflective layer 13 is not provided on the second window pane 2. Inside the light guide 5 a fourth reflector 33 is provided such that the infrared light L is redirected into the light guide 5 in a substantial downward direction which is not parallel to the main surfaces of the first and second reflective layers 12, 13. In the case that the parabolic mirror 43 results in a sufficiently small angular spread of the infrared light L entering the light guide 5, the fourth reflector 33 may be omitted.

The window assemblies 100,110,120,130 may be placed in front of a window or, for example, in front of a wall inside a building.

In summary, the invention provides for a window assembly for irradiating infrared light comprises a light guide for infrared light, which is formed by a gap between a first transparent substrate, having an exterior surface and an interior surface, which faces the light guide, and a second transparent substrate substantially parallel to the first transparent substrate and having an exterior surface and an interior surface, which faces the light guide and the interior surface of the first transparent substrate. A first and a second reflective layer, that are both substantially reflective for infrared light, extend over the interior surfaces of respectively the first and the second transparent substrate. The second reflective layer is provided with an opening through which at least part of the infrared light exits the light guide. In one embodiment, the window assembly further comprises an infrared light source for directing the infrared light into the light guide. In this way the infrared light leaves the light guide in one main direction through the opening of the second reflective layer and through the second transparent substrate, thereby generating heat in one main direction only.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of other elements or steps than those listed in a claim. The word "a" or "an" preceding an element does not exclude the presence of a plurality of such elements.

The invention claimed is:

1. A window assembly for irradiating infrared light, the window assembly comprising a light guide for infrared light, which is formed by a gap between a first transparent substrate, having an exterior surface and an interior surface, which faces the light guide, and a second transparent substrate substantially parallel to the first transparent substrate and having an exterior surface and an interior surface, which faces the light guide and the interior surface of the first transparent substrate, wherein a first reflective layer and a second reflective layer, that are both substantially reflective for the infrared light, extend over the interior surfaces of respectively the first transparent substrate and the second transparent substrate and wherein the second reflective layer is provided with an opening through which at least part of the infrared light exits the light guide.

2. The window assembly according to claim 1, further comprising an infrared light source for directing infrared light into the light guide.

3. The window assembly according to claim 2, further comprising means for directing the infrared light from the infrared light source into the light guide in a direction that is not parallel to the interior surfaces of the first and second transparent substrate.

4. The window assembly according to claim 3, wherein the directing means comprises a parabolic reflector partially surrounding the infrared light source.

5. The window assembly according to claim 4, wherein the parabolic reflector is movable around the infrared light source.

6. The window assembly according to claim 3, wherein a further reflector for infrared light is located in the light guide in the proximity of the infrared light source.

7. The window assembly according to claim 1, further comprising a reflector located on the second transparent substrate for redirecting the exiting infrared light.

8. The window assembly according to claim 7, wherein the reflector is located on the exterior surface of the second transparent substrate.

9. The window assembly according to claim 7, wherein the reflector is transparent for visible light.

10. The window assembly according to claim 2, wherein the infrared light source is located outside the light guide and faces the exterior surface of the first transparent substrate or the exterior surface of the second transparent substrate.

* * * * *